US006147572A

United States Patent [19]

Kaminski et al.

[11] Patent Number: 6,147,572

[45] Date of Patent: Nov. 14, 2000

[54] FILTER INCLUDING A MICROSTRIP ANTENNA AND A FREQUENCY SELECTIVE SURFACE

[75] Inventors: Walter J. Kaminski, Long Valley; Arild Kolsrud, Parsippany, both of N.J.

[73] Assignee: Lucent Technologies, Inc., Murray Hill, N.J.

[21] Appl. No.: 09/115,690

[22] Filed: Jul. 15, 1998

[51] Int. Cl.[7] ..... H01P 1/213; H01P 1/20; H01Q 15/22

[52] U.S. Cl. ..... 333/134; 333/202; 343/909

[58] Field of Search ..... 333/202, 126, 333/129, 134; 343/756, 700 MS, 909

[56] References Cited

U.S. PATENT DOCUMENTS

| | | | |
|---|---|---|---|
| 5,130,718 | 7/1992 | Wu et al. | 343/909 X |
| 5,208,603 | 5/1993 | Yee | 343/909 |
| 5,453,754 | 9/1995 | Fray | 343/700 MS |
| 5,455,594 | 10/1995 | Blasing et al. | 343/756 X |
| 5,497,169 | 3/1996 | Wu | 333/134 |
| 5,563,614 | 10/1996 | Alden et al. | 343/909 X |

OTHER PUBLICATIONS

"Microwave Receivers and Related Components," James Bao–yen Tsui, pp. 221, 236–240, 1985.

"Arrays of Concentric Rings as Frequency Selective Surfaces, " E.A. Parker et al., Electronics Letters, Nov. 12, 1981, vol. 17, No. 23, pp. 880–881.

"UHF and Microwave Devices," Donald G. Fink. Electronics Engineers' Handbook, Library of Congress Cataloging in Publication Data, pp. 9–74–9–75, 1975.

"A Four–Frequency Selective Surface Spacecraft Subreflector Antenna, " Gregory S. Hickey et al., Technical Feature, Microwave Journal, May 1996, pp. 240, 242, 246, 248, 250, 252.

Theoretical and Experimental Study of 2.45 GHZ Rectifying Antennas, A Thesis by James O. McSpadden, Dec. 1993, Chapter V, "Suppression of Harmonic Power by a Frequency Selective Surface," pp. 92–117.

"Equivalent–circuit models for frequency–selective surfaces at oblique angles of incidence," C.K. Lee et al., IEE Proceedings, vol. 132, Pt. H. No. 6, Oct. 1985, pp. 395–399.

"Double–Square Frequency–Selective Surfaces and Their Equivalent Circuit," Electronics Letter, Aug. 18, 1993, vol. 19, No. 17, pp. 675–677, 880–881.

"Four–Band Frequency Selective Surface with Double–Square–Loop Patch Elements," Te–Kao Wu, IEEE Transactions on Antennas and Propagation, vol. 42, No. 12, Dec. 1994, pp. 1659–1663.

"On the Theory of Self–Resonant Grids," I. Anderson, American Telephone and Telegraph Company, The Bell System Technical Journal, vol. 54, No. 10, Dec. 1975, pp. 1725–1731.

"Techniques for Analyzing Frequency Selective Surfaces—A Review," R. Mittra et al., Proceedings of the IEEE, vol. 76, No. 12, Dec. 1998, pp. 1593–1615.

A Frequency–Selective Surface Using Aperture–Coupled Microstrip Patches,: R. Pous et al., IEEE Transactions on Antennas and Propagation, vol. 39, No. 12, Dec. 1991, pp. 1763–1769.

*Primary Examiner*—Robert Pascal
*Assistant Examiner*—Barbara Summons

[57] ABSTRACT

A filter including an enclosure, a dielectric material within the enclosure, at least two microstrip antennas within the enclosure, and at least one frequency selective surface including a metallic pattern. The frequency selective surface is utilized to filter an electromagnetic signal propagated within the enclosure. The geometry of the antennas and the frequency selective surfaces as well as the resonant frequencies of the frequency selective surfaces determine whether the filter is a bandpass, bandstop, notched, or combination filter. If the frequency selective surface is omitted, the combination acts as a delay circuit for delaying the electromagnetic signal, where the time delay is a function of the dielectric constant of the dielectric material.

22 Claims, 3 Drawing Sheets

FILTER INCLUDING A MICROSTRIP ANTENNA AND A FREQUENCY SELECTIVE SURFACE

BACKGROUND OF THE INVENTION

Conventional circuit boards are densely populated with numerous components. These components, because of their close proximity, often emanate electromagnetic signals which interfere with the operation of other components on the circuit board. In particular, conventional frequency filters which typically filter signals in the microwave band are a large source of spurious electromagnetic radiation.

SUMMARY OF THE INVENTION

The present invention solves this problem by providing a small and cost efficient filter for high frequencies (microwave signals from 1–25 GHz and millimeter wave signals over 25 GHz). The size of the filter is inversely proportional to the desired frequency of operation. The filter of the present invention is completely shielded with minimal leakage out of the filter which might interfere with other components on the circuit board, resulting in cost and size reductions of the overall circuit.

The present invention also provides a small and cost efficient delay circuit for high frequencies (for example, 5 GHz with a wavelength of approximately 11 mm with a dielectric constant $\epsilon_r$=30). The delay circuit of the present invention is also completely shielded with minimal leakage out of the delay circuit which might interfere with other components on the circuit board.

In more detail, the present invention is a filter which utilizes microstrip (also known as "patch") antennas as a source and a sink antenna and propagates the electromagnetic signal from the source antenna to the sink antenna through a dielectric material within an enclosure. Embedded in the dielectric material is at least one frequency selective surface which has a metallic pattern imprinted thereon, which rejects a certain frequency or frequencies. Depending on the geometry, the combination of the enclosure, dielectric material, source and sink antennas, and at least one frequency selective surface can be utilized to create a bandpass filter, a notched filter, or a combination bandpass and notched filter, which is fully shielded and emanates minimal electromagnetic interference.

The present invention is also a delay circuit which utilizes microstrip antennas as a source and a sink antenna and propagates an electromagnetic signal from the source antenna to the sink antenna through a dielectric material within an enclosure. The delay circuit does not include at least one frequency selective surface. The combination of the enclosure, dielectric material, and source and sink antennas creates a delay circuit, where the time length of the delay is a function of the dielectric constant of the embedded dielectric material.

DETAILED DESCRIPTION OF THE INVENTION

The present invention discloses a small and cost efficient filter for very high frequencies (above 1 GHz) which emanates minimal electromagnetic reduction which would interfere with other components on circuit boards near the filter itself. The basic principle is to provide two antennas, a source antenna and a sink antenna, and a high dielectric material with one or more frequency selective surfaces embedded in the dielectric material which act as screens for rejecting certain frequencies. Microstrip or patch antennas are ideal for this purpose because they require a ground plane, which is a necessity in a filter to provide shielding.

The high dielectric material's purpose is to shrink the guided wavelength in the medium since the wavelength is a function of both the frequency of operation and the dielectric constant of the dielectric material. The guided wavelength for any homogeneous dielectric material is given by $$\lambda_g = \frac{c}{f\sqrt{\varepsilon_r}} \tag{1}$$

where c is the speed of light ($3*10^8$ m/s), f is the frequency in Hz, and $\epsilon_r$ is the relative dielectric constant for the material of interest.

Figure 1A:
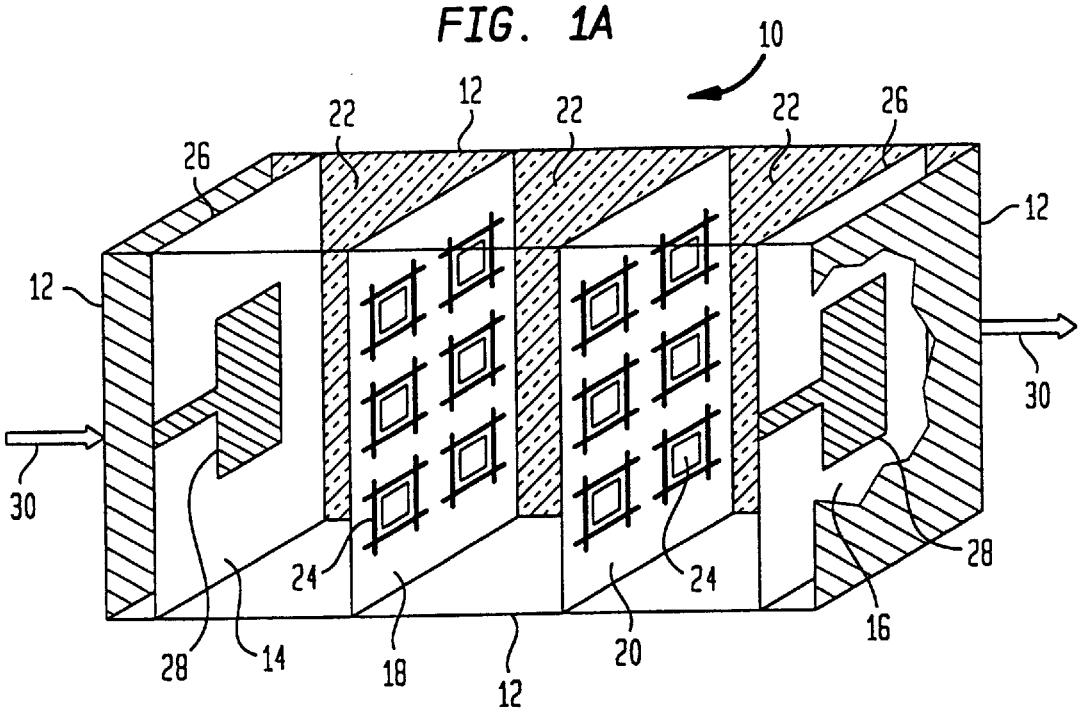
FIGS. 1(*a*) and 1(*b*) are block diagrams illustrating the filter of the present invention in a first embodiment.
Figure 1B:
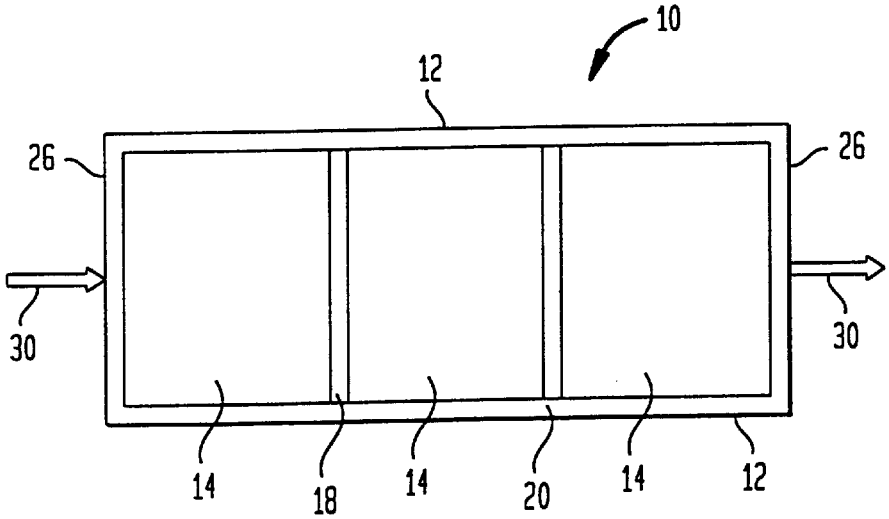

The filter 10 of the present invention, in one embodiment, is illustrated in FIGS. 1(*a*) and 1(*b*). The filter 10 is a reciprocal circuit where either end can be the input or the output. The Lorentz reciprocity theorem states that an antenna has the same radiation pattern for a receive mode as well as for a transmit mode as set forth below $$\int\int_{va}\int (E_b \cdot J_a - H_b \cdot M_a)dl'v = \int\int_{vb}\int (E_a \cdot J_b - H_a \cdot M_b)dl'v \tag{2}$$

where $v_a$ and $v_b$ are the volume of the source and sink antennas, $E_a$ and $E_b$ are the electric fields generated by antennas a and b, $J_a$ and $J_b$ are the electric source volume currents of a and b, while the magnetic source volume currents $M_a$ and $M_b$ are usually zero which eliminates the $H_x \cdot M_y$ terms of equation (2). The Lorentz reciprocity theorem, set forth in equation (2) states that the electric field at antenna b which is generated by an antenna a vector multiplied by the electric volume current on antenna b is equal to the electrical field at antenna a which is generated by an antenna b vector multiplied by the electric volume current at antenna a.

FIGS. 1(*a*) and 1(*b*) illustrate the major components of the filter 10 of the present invention in one embodiment. In particular, FIGS. 1(*a*) and 1(*b*) illustrate an enclosure 12, a microstrip antenna 14, a microstrip antenna 16, two frequency selective surfaces 18 and 20, and a solid dielectric material 22. One purpose of the enclosure 12 is to provide EMI shielding so the enclosure 12 is made of metal, carbon-doped plastic, or even a dielectric material with a substantially higher dielectric constant than the solid dielectric material 22. The enclosure 12 may also be solid or mesh. Each frequency selective surface 18, 20 includes a metallic pattern 24, printed thereon. The frequency selective surfaces 18, 20 are embedded in the dielectric material 22. The enclosure 12 fully surrounds the dielectric material 22 and the frequency selective surfaces 18, 20.

Each microstrip antenna 14, 16 includes a ground plane 26 and a conductor 28. In the embodiment illustrated in FIGS. 1(*a*) and 1(*b*), the enclosure 12 also acts as the ground plane 26 for the microstrip antennas 14, 16. The conductor 28 on the microstrip antennas 14, 16 is made of one of aluminum, copper, silver or gold and may be circular, rectangular, or oval in shape. The microstrip antennas 14, 16 may be produced by printed circuit technology or substrate etching. The microstrip antennas 14, 16 also may be a microstrip-fed slot antenna. The frequency selective surfaces 18, 20 are produced from thin film technology, and are typically 1–5 mm thick. The metallic pattern 24 is made of one of copper, silver, aluminum, or gold. The dielectric material 22 is a solid dielectric, such as a ceramic with an dielectric constant of 1.1 to 10,000, where the velocity $V_p$ of propated electromagnetic signal is:

$$V_p = \frac{c}{\sqrt{\varepsilon_r}} \tag{3}$$

where $c=3.0\times10^8$ m/s and $\epsilon_r$ is the dielectric constant.

As illustrated in FIGS. 1(*a*) and 1(*b*), the frequency selective surfaces 18, 20 include a periodically repeating metallic pattern 24 printed on thin film technology. The metallic pattern 24 has a shape such that it resonates for one or more specific frequencies, hence acting as a bandstop filter. When a propagating electromagnetic signal 30 encounters one of the frequency selective surfaces 18, 20, the energy belonging to the frequency (or frequencies) that correspond to the resonance frequency (or frequencies) of the metallic pattern 24 is absorbed by the metallic pattern 24 and reflected back in accordance with Snell's Law of refraction $$\frac{\sin\theta_t}{\sin\theta_i} = \sqrt{\frac{\varepsilon_{r1}}{\varepsilon_{r2}}} \tag{4}$$

where $\theta_t$ is the angle of the reflected wave, $\theta_i$ is the angle of the incident wave, $\epsilon_{r1}$ is the relative dielectric constant of the media the wave is incident from, and $\epsilon_{r2}$ is the relative dielectric constant of the media the wave is incident to.

The frequency selective surfaces 18, 20 appear transparent to all other frequencies other than the resonance frequency (or frequencies).

In order to produce a notched filter 10, as illustrated in FIGS. 1(*a*) and 1(*b*), the angle of incidence of the propagating electromagnetic signal 30 with the frequency selective surfaces 18, 20 is assumed, but not limited, to be normal incidence. Several frequency selective surfaces with different resonance frequencies may be positioned, one after each other, as illustrated in FIGS. 1(*a*) and 1(*b*), to achieve any desired frequency response. The metallic pattern 24 printed on the thin film technology can be, but is not limited to, metallic strips shaped into squares (or rectangles) as illustrated in FIG. 1(*a*). Circular shapes, Jerusalem crosses, concentric rings, double squares or gridded squares can also be utilized as the metallic pattern 24.

Figure 2:
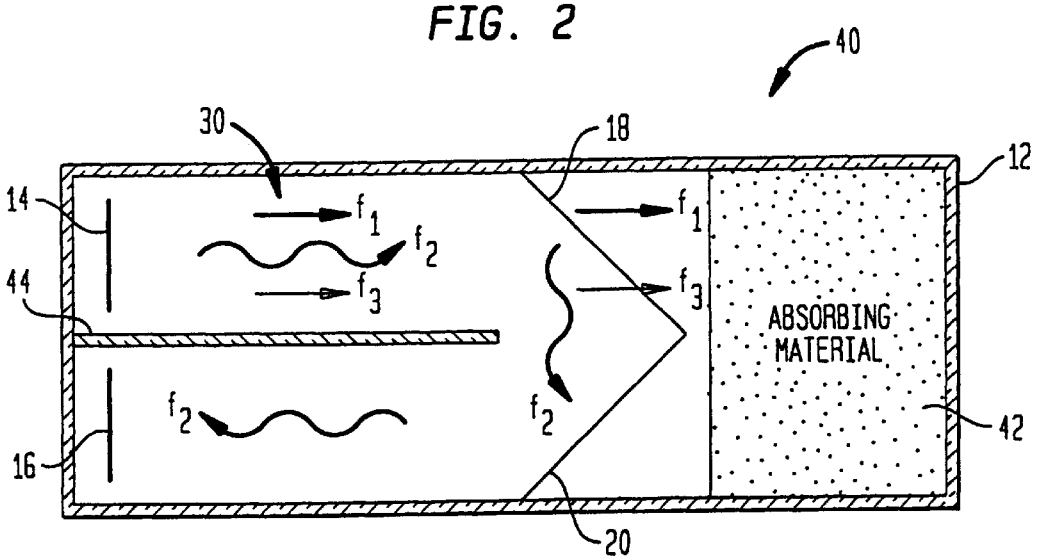
FIG. 2 illustrates the filter of the present invention in a second embodiment.

FIG. 2 illustrates another embodiment of the present invention, in particular, a bandpass filter 40. The bandpass filter 40 includes an enclosure 12, a microstrip antenna 14 acting as a transmit antenna, a microstrip antenna 16 acting as a receive antenna, two frequency selective surfaces 18, 20, absorbing material 42, and divider 44, made of the same material as the enclosure 12. The propagating electromagnetic signal 30 is transmitted by the transmit antenna 14 and impinges on frequency selective surface 18, which has a resonant frequency (or frequency band) $f_2$. All other frequencies, namely $f_1$, $f_3$ are permitted to pass through the frequency selective surface 18 and are absorbed by absorbing material 42. The frequency $f_2$, which has been reflected from the frequency selective surface 18 impinges on frequency selective surface 20. Again, frequency $f_2$ is reflected by the frequency selective surface 20, which has the same resonant frequency as frequency selective surface 18. Frequency $f_2$ is reflected by frequency selective surface 20 to the receive antenna 16. The signal received by receive antenna 16 includes only the frequency $f_2$, thereby acting as a bandpass filter 40. Divider 44 prevents any interference between the propagating electromagnetic signal 30 (including $f_1$, $f_2$ and $f_3$) and the received signal $f_2$ at the receive antenna 16 as well as internal coupling between the transmit antenna 14 and the receive antenna 16.

In a preferred embodiment, as illustrated in FIG. 2, the two frequency selective surfaces 18, 20 are positioned at 45° with respect to the microstrip antennas 14, 16 and 90° with respect to each other.

Figure 3:
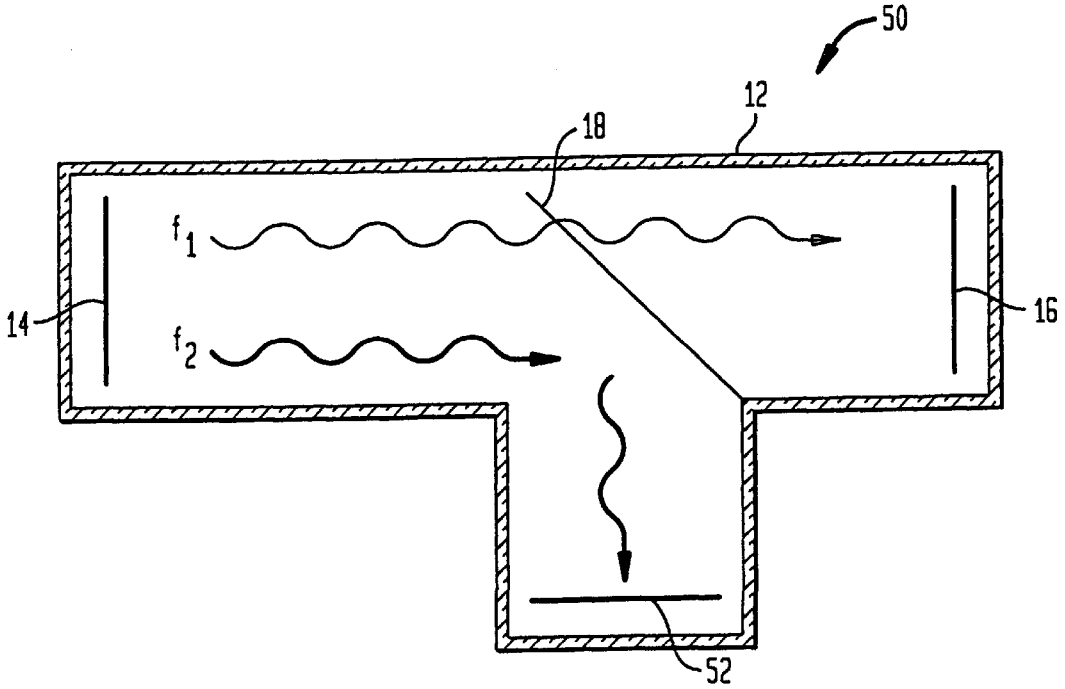
FIG. 3 illustrates the filter of the present invention in a third embodiment.
Figure 4A:
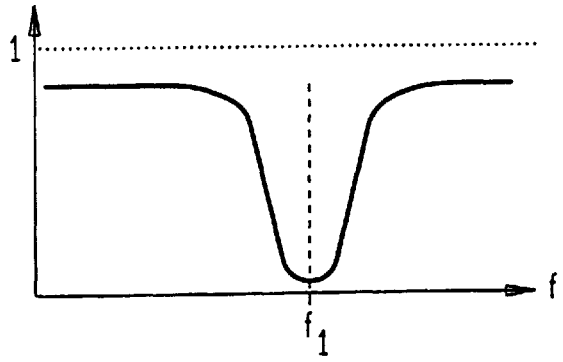
FIGS. 4(*a*) and 4(*b*) illustrate the frequency response produced by the filter of FIG. 3.
Figure 4B:
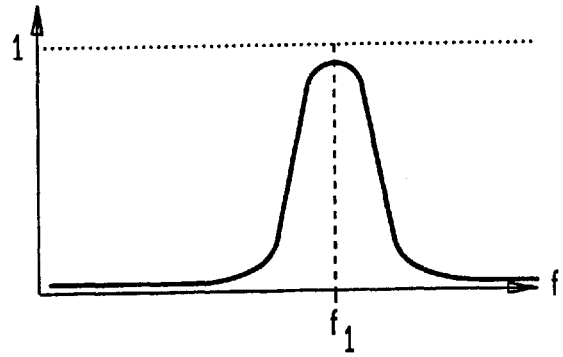

FIG. 3 illustrates a third embodiment of the present invention, in particular, a combined notched and bandpass filter 50. The combined notched and bandpass filter 50 includes an enclosure 12, microstrip antennas 14, 16, 52, and a frequency selective surface 18. The microstrip antenna 14 acts as a transmit antenna and transmits frequencies (or frequency bands) $f_1$ and $f_2$. The frequency selective surface 18 has a resonant frequency equal to $f_2$, and therefore, frequency $f_1$ is permitted to pass and be received at microstrip antenna 16, whereas frequency $f_2$ is reflected and received at microstrip antenna 52. The signal received at microstrip antenna 16 is a notched signal as illustrated in FIG. 4 (*a*), whereas the signal received at microstrip antenna 52 is a bandpass signal, as illustrated in FIG. 4(*b*).

As set forth above, a filter with any type of desired response can be constructed using the major components described above. Further, filters constructed in accordance with the above description have reduced radiation leakage and loss over conventional surface acoustic wave (SAW) or microstrip filters. Further, filters constructed in accordance with the above description also permit operation in the millimeter wave range.

Figure 5:
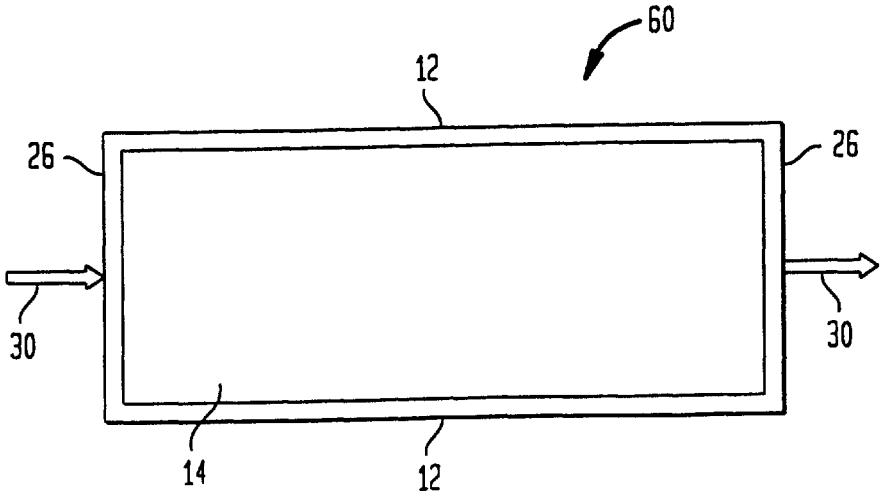
FIG. 5 illustrates the delay circuit of the present invention in a fourth embodiment.

FIG. 5 illustrates another embodiment of the present invention, in particular, a delay circuit 60, which includes the enclosure 12, two microstrip antennas 14, 16, and the dielectric material 14. In delay circuit 60, the higher the dielectric constant of the dielectric material 14, the slower the electromagnetic signal 30 propagates. By controlling the dielectric constant, one can design a delay circuit 60 which delays the electromagnetic signal 30 by the desired time.

As set forth above, a delay circuit with any length of delay time can be constructed using the major components described above. Further, delay circuits constructed in accordance with the above description have reduced radiation leakage, improved performance, and smaller size over conventional delay circuits.

What is claimed:

1. A filter, comprising:

an enclosure;

a dielectric material, within said enclosure;

at least two microstrip antennas, within said enclosure each of said at least two microstrip antennas including a conductor and a ground plane; and at least one frequency selective surface, including a metallic pattern, within said enclosure and encapsulated by said dielectric material, wherein said at least one frequency selective surface is between said at least two microstrip antennas;

wherein said at least one frequency selective surface is embedded in said dielectric material;

wherein said enclosure encapsulates said at least one frequency selective surface;

wherein said at least one frequency selective surface filters an electromagnetic signal propagated within said enclosure.

2. The filter of claim 1, wherein the filter is a reciprocal circuit.

3. The filter of claim 1, wherein the dielectric material and said at least one frequency selective surface are between said at least two microstrip antennas.

4. The filter of claim 1, wherein each of two walls of said enclosure act as the ground plane for each of said at least two microstrip antennas.

5. The filter of claim 1, wherein the metallic pattern repeats periodically and has at least one resonant frequency.

6. The filter of claim 5, wherein the metallic pattern on each of said at least one frequency selective surfaces is one of square, circular, rectangular, concentric rings, double squares, gridded squares and Jerusalem crosses.

7. The filter of claim 1, wherein said enclosure shields the filter.

8. The filter of claim 1, wherein the metallic pattern on each of said at least one frequency selective surfaces reflects at least one frequency.

9. The filter of claim 1, wherein the electromagnetic signal is a microwave or millimeter wave signal.

10. The filter of claim 1, wherein the dielectric material is between said at least two microstrip antennas and said at least one frequency selective surface.

11. A filter, comprising:

an enclosure;

a dielectric material, within said enclosure;

at least two microstrip antennas, within said enclosure; and at least one frequency selective surface, including a metallic pattern, within said enclosure and encapsulated by said dielectric material;

wherein said at least one frequency selective surface is embedded in said dielectric material;

wherein said enclosure encapsulates said at least one frequency selective surface;

wherein said at least one frequency selective surface filters an electromagnetic signal propagated within said enclosure, wherein the electromagnetic signal is a microwave or millimeter wave signal, wherein each of said at least two microstrip antennas and each of said at least one frequency selective surfaces are arranged in substantially parallel planes.

12. The filter of claim 11, wherein the filter is a notch filter.

13. A filter, comprising:

an enclosure;

a dielectric material, within said enclosure;

at least two microstrip antennas, within said enclosure; and at least one frequency selective surface, including a metallic pattern, within said enclosure and encapsulated by said dielectric material;

wherein said at least one frequency selective surface is embedded in said dielectric material;

wherein said enclosure encapsulates said at least one frequency selective surface;

wherein said at least one frequency selective surface filters an electromagnetic signal propagated within said enclosure, wherein the metallic pattern on each of said at least one frequency selective surfaces reflects at least one frequency, wherein said at least two microstrip antennas includes two microstrip antennas, separated by a divider, one acting as a transmitter of several frequencies along a signal path and the other acting as a receiver of a specific frequency band;

wherein said at least one frequency selective surface includes two frequency selective surfaces, arranged at an acute angle to the signal path, one of the frequency selective surfaces receiving the several frequencies from the transmitter and reflecting the specific frequency band, along with the second frequency selective surface, to the receiver.

14. The filter of claim 13, wherein the filter is a reciprocal circuit.

15. The filter of claim 13, wherein a remainder of the several frequencies are passed by the first frequency selective surface and absorbed by absorbing material.

16. The filter of claim 13, wherein the filter is a bandpass filter.

17. A filter, comprising:

an enclosure;

a dielectric material, within said enclosure;

at least two microstrip antennas, within said enclosure; and at least one frequency selective surface, including a metallic pattern, within said enclosure and encapsulated by said dielectric material;

wherein said at least one frequency selective surface is embedded in said dielectric material;

wherein said enclosure encapsulates said at least one frequency selective surface;

wherein said at least one frequency selective surface filters an electromagnetic signal propagated within said enclosure, wherein the metallic pattern on each of said at least one frequency selective surfaces reflects at least one frequency, wherein said at least two microstrip antennas includes three microstrip antennas, one acting as a transmitter of several frequencies along a signal path and two acting as receivers;

wherein said at least one frequency selective surface includes one frequency selective surface, arranged at an acute angle to the signal path, the frequency selective surface receiving the several frequencies from the transmitter and reflecting a specific frequency band to the first receiver and passing a remainder of the frequencies, excluding the specified frequency band, to the second receiver.

18. The filter of claim 17, wherein the filter is a combined notch and bandpass filter.

19. A method of filtering an electromagnetic signal, comprising the steps of:

passing the electromagnetic signal through a dielectric, at least two microstrip antennas, each of said at least two microstrip antennas including a conductor and a ground plane, and at least one frequency selective surface, further including a metallic pattern, wherein said at least one frequency selective surface is between said at least two microstrip antennas; and filtering the electromagnetic signal using the metallic pattern of the at least one frequency selective surface.

20. The method of claim 19, further comprising the step of:

shielding the electromagnetic signal during the passing and filtering steps.

21. The method of claim 19, wherein the dielectric material is between said at least two microstrip antennas and said at least one frequency selective surface.

22. The method of claim 19, wherein the dielectric material and said at least one frequency selective surface are between said at least two microstrip antennas.

* * * * *